US006293080B1

(12) United States Patent
Nishihara et al.

(10) Patent No.: US 6,293,080 B1
(45) Date of Patent: Sep. 25, 2001

(54) SEWING THREAD FOR LEATHER PRODUCTS AND LEATHER PRODUCTS PRODUCED BY USING THE SAME

(75) Inventors: Toshio Nishihara; Tuyoshi Torikai, both of Mihara (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 09/202,823

(22) PCT Filed: Jun. 27, 1997

(86) PCT No.: PCT/JP97/02229

§ 371 Date: Dec. 22, 1998

§ 102(e) Date: Dec. 22, 1998

(87) PCT Pub. No.: WO98/00600

PCT Pub. Date: Jan. 8, 1998

(30) Foreign Application Priority Data

Jun. 28, 1996 (JP) ..... 8-168933

(51) Int. Cl.[7] ..... D02G 3/36

(52) U.S. Cl. ..... 57/258; 57/200; 57/223; 57/232; 57/238; 57/250; 57/257

(58) Field of Search ..... 57/220, 223, 232, 57/238, 250, 257, 258

(56) References Cited

U.S. PATENT DOCUMENTS 5,869,182 2/1999 Ebert et al. .

FOREIGN PATENT DOCUMENTS

| | | | |
|---|---|---|---|
| 42 44 731 A1 | | 4/1994 | (DE) . |
| 58-174646 | | 4/1982 | (JP) . |
| 58-156081 | * | 9/1983 | (JP) . |
| 6-185033 | | 7/1994 | (JP) . |
| 7-290577 | | 11/1995 | (JP) . |

OTHER PUBLICATIONS

Japanese Utility Model Publication No. 63–166170.
Patent Abstacts of Japan, vol . 014, No. 273 (E–0940), Jun. 13, 1990.
Derwent Publications Ltd. XP002147887 Abstract.

* cited by examiner

*Primary Examiner*—John J. Calvert
*Assistant Examiner*—Shaun R Hurley
(74) *Attorney, Agent, or Firm*—Sughrue, Mion, Zinn, Macpeak & Seas, PLLC

(57) ABSTRACT

A sewing thread for a leather product composed of fibers attached with a highly water absorbing powdery material on the surface of the fibers, in a ratio of 5 weight % or more based on the weight of the fibers, and a leather product, with excellent water-proof property, prepared by using the same thread.

10 Claims, No Drawings

SEWING THREAD FOR LEATHER PRODUCTS AND LEATHER PRODUCTS PRODUCED BY USING THE SAME

TECHNICAL FIELD

This invention relates to a sewing thread for sewing up a leather, especially leather panels, and more specifically the sewing thread capable of preventing a seam of sewn up leather panels from the penetration of water through the seam.

BACKGROUND ARTS

So far, a natural leather, a leather made from vinyl chloride, a synthetic leather or an artificial leather are widely used for various uses, and in many cases, a product is made by adhering or sewing up such plural leather panels.

Such leather products are required to be imparted with water proof properties in accordance with its use. For example, since in the case of a sport goods such as a pair of sport shoes, a ball for a ball game, etc., the products are sometimes used in a rainy weather, research works have been carried out for reinforcing the water proof properties of these leather products such as applying a water repelling treatment to the leather panels, etc. in order to improve the water proof properties of these leather products.

However, although the improvement of the water proof properties of the leather panel itself is carried out to a certain extent, the fact that the penetration of water into the inside of the products through seams produced by sewing up theses leather panels, remains as a problem.

Then, as to the waterproofness of the seams in the leather products, the present inventors have carried out various research works for preventing the penetration of water into the inside of the leather products by applying a water absorbing sewing thread used for the water proof clothings such as a raincoat, but there was no way of satisfying the waterproofness and the strength of the seams in the leather products receiving a severe shock such as the sport goods.

As for the above water absorbing sewing thread, the following materials are cited. For example, in the specification of Japanese Utility Model Publication No. 63-166170, in order to prepare a pair of boots by sewing a vinyl sheet backlined with a urethane foam, it was proposed to use a fiber produced by twisting an acrylic water absorbing polymer filament around the outside of an acrylic fiber (Lanseal F; Registered Trade Mark, produced by Nippon Exlan Industries, Co., Ltd.) as the sewing thread. In this sewing thread, its outer layer swells by absorbing water to close the seam for aiming at the prevention of the penetration of water from the seam. However, the sewn product produced by using the above sewing thread has insufficient swelling rate of the used thread and strength of the seam, and this method is not suitable for sewing the leather products, especially for the sport leather products.

Also, in the specification of JP-A 6-185033 (hereinafter, JP-A means "Japanese Unexamined Patent Publication"), similarly to the Japanese Utility Model Publication No. 63-166170, it was described to use an ultra water absorbing fiber consisting mainly of an acrylic polymer (Lanseal F; Registered Trade Mark, produced by Toyobo Co., Ltd.) for sewing up two water blocking sheets (prepared from the ultra water absorbing fibers). However, the sewn product produced by using the above sewing thread also has insufficient swelling rate of the used thread and strength of the seam, and this method is not suitable for sewing the leather products, especially for the sport leather products.

Also, in the specification of JP-A 58-174646, a thread obtained by treating an acrylic fiber with an alkali as a machine thread for a water proof products such as a raincoat, an anorak, a tent, etc., was described. But the machine thread is also not suitable for the sewing thread for the leather products, especially for the sewing thread for the sport leather products similarly to the above.

Further, in the specification of JP-A 58-156081, it was described to sew up a water proof cloths such as a raincoat, an anorak, a tent, etc., by using a water proof thread obtained by attaching 5–30 weight % of a low melting resin powder having 150 $\mu$m or less particle diameter thereto. This water proof thread prevents water by closing needle holes by heat-treating the water proof cloth after sewing up the cloth, at a temperature of a melting point of the resin powder. The sewn product produced by using this thread is not suitable for the waterproofing of the leather products, especially for the sport leather products, since the molten resin has hardened at the seam parts and can not deal with a deformation of the seams occurred on receiving a shock, etc., in use thereof, and water penetrates from a crack formed by the shock.

In the specification of JP-A 7-290577, it was described to sew up a product prepared by laminating a water swelling intermediate sheet and a fiber sheet such as a woven, knitted or nonwoven fabric, etc., between two water blocking outside sheets made from a common rubber or a synthetic resin in surface and rear by using a water absorbing sewing thread containing water absorbing fibers having a water swelling and water absorbing layer around a core fiber. However, even by sewing with this water absorbing sewing thread, the effect of closing the seam is insufficient and thids method is insufficient for waterproofing the leather products, especially for the sport leather products.

Thus, a soccer ball prepared by using a conventionally used water absorbing sewing thread, has a defect that the seams of artificial leather panels covering the surface of the soccer ball deform on using the same in a rainy weather, a lot of water penetrates through its crack, and is not only absorbed by a sewing thread having a water absorbing property, but also absorbed by nonwoven fabrics constituting the artificial leather to increase the weight of the ball. And also, at the same time, since it receives a severe shock and the seams get a heavy load more than those of the clothing products, it is required that the sewing thread itself has a sufficient strength.

In this way, since the leather products, especially the sport leather products, more specifically the balls for the ball games, and above all the soccer balls are used in a rainy weather and receive a severe shock, the balls less in penetration of water into the inside of the ball and having the seams of a high strength were required.

Then, in order to solve the defects in these conventional technologies, the object of this invention by the present inventors, is to provide the sewing thread for the leather products excellent in water absorption and strength of the seam. Further, another object of the invention is to provide the leather product excellent in strength of the seams and also a water proof properties, especially having a low dynamic water absorption rate for not losing the water proof properties even in the case of giving a shock thereto, by using the above sewing thread for the leather products.

DISCLOSURE OF THE INVENTION

This invention is a sewing thread for a leather product composed of fibers attached with a highly water absorbing powdery material on the surface of the fibers, in a ratio of 5 weight % or more based on the weight of the fibers, and a leather product, with excellent water-proof property, prepared by using the same thread.

THE BEST FORM FOR EXECUTING THE INVENTION

A sewing thread for the leather products in this invention is the sewing thread composed of fibers attached with a highly water absorbing powdery material on the surface of the fibers in the ratio of 5 weight % or more based on the fiber weight.

Here, as the fibers constituting the sewing thread for the leather products in this invention (hereinafter called as "sewing thread"), although there is no specific limitation provided that it is a conventionally known fiber such as a natural fiber, a synthetic fiber, etc., the fibers preferably have a certain degree of strength at the seams to meet the object of this invention. For this purpose, it is preferable for the fibers used in this invention to be excellent in strength such as a tensile strength, a loop strength, a knot strength, etc. Concretely, for example, by expressing with a tensile strength of a single fiber, it is 2 g/denier or higher, preferably 2.5 g/denier or higher, and in case of using as a bundle of fibers, the tensile strength of the fiber bundle is 1.8 g/denier or higher, preferably 2.2 g/denier or higher. As raw materials of the fibers, concretely, synthetic fibers such as a polyester, a polyamide, etc., are cited. Among them, the polyester is preferred, and a polyethylene erephtahalate is especially preferable.

Also, although the shape of the fibers constituting the sewing thread in this invention is not specifically limited, for example, shapes such as a long fiber, a spun fiber, a braid, a cord, a rope, a cable, etc., are cited. Further, it is preferable for the long fiber to be treated with an interlacing treatment by using an interlace nozzle or a taslan nozzle, or a false twisting treatment. These fibers can be used as the single fiber, or by bundling plural numbers of fibers, but it is preferable to use as a bundle of fibers since the highly water absorbing powdery material can be mingled among each of the fibers. In this case, total denier of the fiber bundle is 6000–13000 denier, preferably 8000–11000 denier. The denier of the single fiber is preferably small so as to attach the highly water absorbing powdery material on the surface of the fibers, and to disperse and mingle the highly water absorbing powdery material to the whole parts of the sewing thread, and is concretely 10 denier or lower, preferably 5 denier or lower. Also, it is allowed to use the fibers by combining single fibers having different deniers and/or different shapes.

As the highly water absorbing powdery material used in this invention, there is no specific limitation provided that it is a powdery material of a cross-linked polymeric material having a water absorbing property, concretely, for example, a cross-linked polymeric material of water soluble vinyl monomers such as (meth)acrylamide, (meth)acrylic acid. 2-acrylamide-2-methylpropane sulfonic acid, vinyl sulfonic acid, styrene sulfonic acid, etc., and a grafted starch, a cyanoethylated starch, a carboxymethylated starch, etc., are cited. Preferably, a cross-linked polymeric material of a water soluble vinyl monomer, and more preferably, a copolymer obtained by copolymerizing an anionic monomer with the cross-linked polymeric material of the water soluble vinyl monomer are used. By copolymerizing the anionic monoer, it is possible to improve the water absorbing property of the obtained copolymer. As the anionic monomers, for example, it is preferable to use a substance obtained by neutralizing acid monomers such as (meth) acrylic acid, 2-acrylamide-2-methylpropane sulfonic acid, vinylsulfonic acid, styrenesulfonic acid, etc., with an alkali metal salt of sodium ion, potassium ion, etc., or with ammonium ion, etc., to attain 50–100 mol % of the degree of neutralization.

As for a method for polymerization to obtain the highly water absorbing powdery material in this invention, a conventionally known method can be used, for example, the powdery material can be obtained by adding a solution obtained by dissolving the anionic monomer with water and neutralizing, into a petroleum-based aliphatic hydrocarbon solvent added with a surfactant, a polymerization initiator, a cross-liking agent, etc., under a nitrogen atmosphere, further substituting the atmosphere of the solution with nitrogen, reacting for several hours, removing the petroleum-based resinous hydrocarbon solvent and water after the completion of the reaction, and drying the obtained polymer. Here, as the petroleum-based resinous hydrocarbon solvent, normal hexane, ligroin, benzene, toluene, xylene, naphthene, etc., are cited.

As the highly water absorbing powdery material in this invention, it is preferable to have 0.1–100 $\mu$m of mean particle diameter under a dried condition, and 0.2–20 $\mu$m thereof is more preferable. The water absorption rate of the highly water absorbing powdery material itself is 20 fold or more in volume increasing ratio thereof, preferably 100 fold or more, and more preferably 200–500 fold.

The sewing thread in this invention is the above fiber attached with the highly water absorbing powdery material on the surface thereof The attached amount of the highly water absorbing powdery material is 5 weight % or more, preferably 5–70 weight %, more preferably 7–25 weight % based on the fiber weight. In case that the attached amount is less than 5 weight %, the dynamic water absorbing rate of a soccer ball prepared by using the sewing thread of this invention is high and the effect of this invention can not be attained. Also, the more effect of this invention can be obtained by the more the attached amount, but in case that the attached amount is larger than 70 weight %, the falling off of the highly water absorbing powdery material attached to the fiber becomes large amount and effectless. Also, in considering the practical effect and economical property on using the highly water absorbing powdery material with the sewing thread for the soccer ball, the attached amount of the highly water absorbing powdery material is most preferably 7–25 weight % based on the fiber weight.

As the attached state of the highly water soluble powdery material, it is preferable for the powdery material to be attached uniformly on the fiber surface, and as to the fiber bundle, the material is preferably dispersed and mingled into the inside of the fiber bundle. In this way, by the fact that the highly water absorbing powdery material is dispersed and mingled into the inside of the fiber bundle, in the case that the highly water absorbing powdery material makes a contact with water, the highly water absorbing powdery material swells, the swollen highly water absorbing powdery material is restrained among the each of the fibers to yield a packing effect, as a result, the seams are effectively blocked and it is also possible to perform a packing in accordance with the deformation of the holes in the seams.

As for the attaching method of the highly water absorbing powdery material, a conventionally known methods such as a method of immersing the fibers in a dispersion liquid containing the highly water absorbing powdery material, a method of spraying the highly water absorbing powdery material to the fibers, etc., can be used. Concretely, for example, the fiber attached with the powdery material is obtained by immersing the fiber in a dispersion liquid containing the highly water absorbing powdery material by 10–55 weight %, preferably by 20–45 weight % based on the weight of the dispersion liquid at a room temperature for 0.5 sec to 1 minute, dispersing and mingling the highly water absorbing powdery material into even the inside of the fiber bundles, squeezing suitably so as to attain a prescribed attached amount and then drying. As the dispersion solution, although there is no specific limitation provided that it is a non-solvent for the highly water absorbing powdery material, concretely, it is preferable to use the mixed solvent of water with the petroleum-base resinous hydrocarbon solvent used in the polymerization of the highly water absorbing powdery material as it is.

Further, in the dispersion liquid containing the highly water absorbing powdery material, it is preferable to add an adhesive. As the adhesive, a vinyl acetate resin, a urethane-based resin, an acrylic resin, a nitrile rubber-based resin, chloroprene-based resin, a polyester-based resin, etc., are cited. As a solvent for the adhesives, an aqueous solvent, an organic solvent, etc., are used and the aqueous solvent is preferably used. The using amount of the adhesive is 20 weight % or less, preferably 3–15 weight % based on the weight of the highly water absorbing powdery material.

The attachment of the highly water absorbing powdery material can be performed before or after the formation of the fibers as the fiber bundles, or before or after the performance of the interlacing or false twisting treatment of the single fiber.

The sewing thread for the leather products thus obtained, has excellent strength at the seams and water absorbing property. Also by sewing up the leather panels by using the above sewing thread for the leather products, leather products having an excellent water proof property can be obtained.

As the leather panels sewn up by using the sewing thread of this invention, there is no specific limitation provided that they are made of a leather, and a natural leather, a leather made from vinyl chloride, a synthetic leather, an artificial leather, etc., are cited. Among them, in order to exhibit the effect of the sewing thread in this invention efficiently and obtain the leather products having an excellent water proof property, it is preferable to use a leather having an excellent water proof property such as the synthetic leather and the artificial leather. Also, it is preferable to have a water proof treatment on these leathers themselves.

Here, as the synthetic leather, it means, for example, an article obtained by impregnating a urethane polymer solution or emulsion liquid to a fabric composed of fibers of a polyester or a nylon, coagulating, drying and coating a urethane resin on the surface thereof, and as the artificial leather, it means, for example, an article obtained by impregnating a urethane polymer solution or emulsion liquid to a nonwoven fabric composed of fibers of a polyester or a nylon, coagulating, drying and coating a urethane resin on the surface thereof.

The leather panels are prepared by cutting these -leathers according to the objective products. As the leather products obtained by sewing up these leather panels, there is no specific limitation, but for example, sport goods, interior goods, clothings, etc., are cited. Among them, as the products in which the effect of the sewing thread of this invention is exhibited most, sport goods used in a rainy weather, especially a ball for the ball game such as the soccer ball, the rugby ball, etc., and more specifically the soccer ball are preferably cited. That is, by using the sewing thread in this invention for the production of the soccer ball, it becomes possible to prevent the rain water from being absorbed to the inside of the soccer ball, i.e., into the nonwoven fabric constituting the artificial leather by absorbing the rain water with the highly water absorbing powdery material attached to the sewing thread in this invention and swelling the highly water absorbing powdery material to close the holes of the seams. The soccer ball obtained by using the sewing thread in this invention, has a high water proof property, and it becomes possible to reduce a water absorption rate thereof, especially a dynamic water absorption rate widely and to make the dynamic water absorption rate as 5% or less, preferably 2% or less.

EXAMPLE

This invention is described in details by showing examples as follows, but these examples are by no means limiting this invention.

In these examples, parts or % means parts weight and weight %. And various measurements are performed by the following methods.

1. Mean particle diameter of the highly water absorbing powdery material

By taking some of the highly water absorbing powdery material on a slide glass, dispersing the material so as not to overlap the particles each other and selecting a suitable position, a photograph was taken by using an optical microscope. From the image of the particles in the photograph, the largest diameter and the smallest diameter of a particle were measured to set a mean diameter of one particle by calculating a mean of these values. Such mean particle diameters are obtained with 50 particles, and mean values of them were calculated. The obtained mean value was set as the mean particle diameter of the highly water absorbing powdery material.

2. Preparation of leather panel

The leather sheet for the test, was cut by 5 cm length and 7 cm width. The side surface of the cut leather sheet for the test was treated with a urethane sealing agent, and the back side thereof was adhered with a polyethylene terephthalate film so as to prevent the penetration of water from the side and back surfaces of the panel. Holes were bored on the obtained panel at 10 positions by a drill, the sewing thread was inserted through the holes and an initial weight of the panel was measured.

3. Dynamic water absorption rate of the leather panel

The leather panel was immersed in a water bath, and hit by a cylinder having 12 cm diameter for 200 times. The leather panel was then taken out, wiped out water attached to the surfaces quickly and measured its weight for obtaining a weight increasing ratio based on the initial weight. The obtained increasing ratio was set as the dynamic water absorption rate of the leather panel.

4. Dynamic water absorption rate of a ball

It was measured in accordance with the water absorbing property test standard (for an "officially approved" ball) set by Federation of International Football Associations (FIFA), i.e., by measuring the initial weight of the soccer ball having 0.8 bar air pressure in the ball, then putting the ball into a cylindrical vessel having 7.5 cm diameter and containing water of 2 cm depth, bouncing the ball so as to attain 25% deformation amount of the soccer ball, repeating the same for 250 times, taking the ball out directly afterward, wiping out the water attached to the surface thereof quickly, and measuring the weight of the ball to calculate the weight increasing ratio based on the initial weight, and the obtained increasing ratio was set as the dynamic water absorption rate of the ball.

5. Falling off resistance of the highly water absorbing powdery material

The falling off resistance is judged by the state of falling off on abrading the sewing thread composed of the fibers attached with the highly water absorbing powdery material on the surface of the fibers.

○: No fall off of the highly water absorbing powdery material is observed even rubbing with fingers and the material does not attach to finger tips.

Δ: A part of the highly water absorbing powdery material falls off by rubbing with the fingers.

×: A part of the highly water absorbing powdery material falls off only touching with the fingers.

Reference Example 1

Production of the Artificial Leather

A base material was obtained by immersing a nonwoven fabric composed of polyethylene terephthalate fibers of 400 g/m$^2$ into a dimethylformamide solution dissolving 16% of a urethane polymer, coagulating the polymer, and drying the fabric. The unit weight of the base material was 650 g/m$^2$. An artificial leather having 700 g/m$^2$ unit weight and 1.5 mm thickness was obtained by performing a gravure coating of a urethane resin solution for finishing on the surface of the base material.

By using the obtained artificial leather, leather panels were prepared.

Reference Example 2

Production of the Highly Water Absorbing Powdery Material

Into a four-necked one litter flask equipped with an agitator, 450 ml of a naphthene having 198–235° C. boiling point was placed, 7.5 g of sorbitane monostearate as a surfactant was added, and oxygen in the solution was substituted by blowing nitrogen gas therein.

An aqueous solution obtained by dissolving 50 g of acrylic acid neutralized by 70% with sodium hydroxide, with 60 g of water was added into the above solution. Then, after adding 0.2 g of potassium persulfate as a polymerization initiator and dissolving, nitrogen gas was again blown into the solution for removing oxygen presenting in the solution. After reacting at 65° C. for 5 hours with an agitation, 0.06 g of ethylene glycol diglycidyl ether as a cross-linking agent dissolved with 2 ml of water was added and reacted further for 2 hours while agitating.

Then, the naphthene and water were distilled off, and the residual material was dried to obtain a cross-linked acrylic acid polymer as the highly water absorbing powdery material. The mean particle diameter of the obtained cross-linked acrylic acid polymer was 1.3 $\mu$m and water absorbing rate was 300 fold based on a volume increasing ratio with water.

Example 1

Eleven of lightly twisted 48 monofilaments of a polyethylene terephthalate (3.5 denier, 4.5 g/denier of tensile strength) were bundled and twisted by 115 times as Z-twists. Five bundles of the above bundle were further bundled and twisted by 120 times as S-twists to obtain a twisted yarn having 9240 total denier. The tensile strength of the obtained twisted yarn was measured as 3.3 g/denier.

The above twisted yarn was immersed in a dispersion liquid prepared so as to contain 40% of the highly water absorbing powdery material obtained by the above example in a non-solvent for the highly water absorbing powdery material and added with a water dispersible polyester resin as an adhesive so as to become 7 weight % based on the highly water absorbing powdery material, for 10 seconds, excessive liquid was sqeezed by passing through a slit, and the yarn was dried in a drying oven and then wound up by a winder. The attached amount of the highly water absorbing powdery material was 13 weight %.

The obtained sewing thread was sewn in the leather panels and the dynamic water absorption rates were measured.

Further, the leather panels for a soccer ball were sewn up by using the obtained sewing thread to make the soccer ball, and the dynamic water absorption rate was measured. The results are shown in Table 1.

Examples 2–6 and Comparative Examples 1 to 2

Procedures similar to Example 1 were conducted except for the amounts of the highly water absorbing powdery material attached to the twisted yarns. The results are shown in the Table 1.

Comparative Example 3

A soccer ball was made by sewing up the leather panels for the soccer ball used in Example 2 by using a twisted yarn having 9100 total denier obtained by bundling an acrylic fiber showing water swelling property (Lanseal F, Registered trade mark, made by Nippon Exlan Industries, Co., Ltd.) with a polyethylene terephthalate fiber in a denier ratio of 1:1.

The dynamic water absorption rate of the obtained ball was measured and it was 39%.

TABLE 1

| | Attached amount of the powdery material (%) | Dynamic water absorption rate (%) of the panel | Dynamic water absorption rate (%) of the ball | Fall off resistance of the powdery material |
|---|---|---|---|---|
| Comparative Example 1 | 0 | 48 | 12 | — |
| Comparative Example 2 | 3 | 38 | 10 | ○ |
| Comparative Example 3 | — | — | 39 | — |
| Example 1 | 13 | 28 | 4.5 | ○ |
| Example 2 | 21 | 25 | 4 | ○ |
| Example 3 | 30 | 36 | 1.3 | ○ |
| Example 4 | 36 | 21 | 0.5 | ○ |
| Example 5 | 65 | 15 | 0.5 | ○- Δ |
| Example 6 | 90 | 15 | 0.5 | X |

EFFECT OF THE INVENTION

As described above, the leather products prepared by using the sewing thread for the leather products in this invention, have an excellent water proof property. Also, the sport leather products prepared by using the sewing thread for the leather products in this invention can endure the use in a rainy weather, and maintain the water proof property thereof even getting a sever shock thereto.

What is claimed is:

1. A sewing thread for a leather product comprising fibers attached with a highly water absorbing powdery material on the surface of the fibers in a ratio of 5 weight % or more based on the weight of the fibers.

2. The sewing thread for a leather product described in claim 1, wherein the ratio of the highly water absorbing powdery material attached to the surface of the fibers is 5 to 70 weight % based on the weight of the fibers.

3. The sewing thread for a leather product described in claim 1, wherein a mean particle diameter of the highly water absorbing powdery material is 0.1 to 100 $\mu$m.

4. The sewing thread for a leather product described in claim 1, wherein the highly water absorbing powdery material is a cross-linked acrylic acid polymer.

5. The sewing thread for a leather product described in claim 1, wherein the fibers are polyester fibers.

6. The sewing thread for a leather product described in claim 1, wherein the leather product is an artificial leather.

7. A leather product prepared by sewing up leather panels using a sewing thread for a leather product described in any one of the claims 1 to 6.

8. The leather product described in claim 7, wherein the leather product is a sport leather product.

9. The leather product described in claim 8, wherein the sport leather product is a ball for a ball game.

10. The leather product described in claim 9, wherein the ball for the ball game is a soccer ball.

* * * * *